US007645926B2

(12) United States Patent
Jerrolds

(10) Patent No.: US 7,645,926 B2
(45) Date of Patent: Jan. 12, 2010

(54) FIDDOLIN

(76) Inventor: Clennon Wayne Jerrolds, 300 Riverfront Dr., Savannah, TN (US) 38372

( * ) Notice: Subject to any disclaimer, the term of this patent is extended or adjusted under 35 U.S.C. 154(b) by 0 days.

(21) Appl. No.: 11/363,981

(22) Filed: Feb. 28, 2006

(65) Prior Publication Data

US 2007/0199433 A1 Aug. 30, 2007

(51) Int. Cl.

| | |
|---|---|
| ***G10D 3/00*** | (2006.01) |
| ***G10D 3/04*** | (2006.01) |
| ***G10D 3/06*** | (2006.01) |
| ***G10D 1/00*** | (2006.01) |
| ***G10D 1/02*** | (2006.01) |
| ***G10D 1/06*** | (2006.01) |

(52) U.S. Cl. ..... 84/263; 84/291; 84/293; 84/314 R; 84/282; 84/268; 84/274; 84/275

(58) Field of Classification Search ..... 84/290, 84/291, 293, 314 R, 282, 263
See application file for complete search history.

(56) References Cited

U.S. PATENT DOCUMENTS

| | | | | |
|---|---|---|---|---|
| 546,374 | A * | 9/1895 | Babbitt | 84/263 |
| 668,060 | A * | 2/1901 | Shelton | 84/263 |
| 1,723,751 | A * | 8/1929 | Turturro | 84/263 |
| 1,773,133 | A * | 8/1930 | Faccaro | 84/275 |
| 3,860,876 | A * | 1/1975 | Woods | 84/737 |
| 4,501,186 | A * | 2/1985 | Ikuma | 84/726 |
| 4,684,047 | A * | 8/1987 | Burgwin | 224/665 |

* cited by examiner

*Primary Examiner*—Jeffrey Donels
*Assistant Examiner*—Andrew R Millikin
(74) *Attorney, Agent, or Firm*—Charles F. Rye

(57) ABSTRACT

A stringed musical instrument combination of at least two traditional stringed musical instruments or of nontraditional stringed musical instruments or a mix of traditional and non-traditional. The combination presents the advantages of rapid exchange while playing, reduced storage or transportation volume and a lower cost than two separate instruments. The preferred embodiment is a Fiddolin, a commercially available violin modified to present a mandolin on its back face. The string tension requirement is solved by having additional structure to mount the mandolin pegs into and the angularity needed to keep the strings pulled over the nut by channels or lumens to conduct the strings through.

7 Claims, 2 Drawing Sheets

FIDDOLIN

SUMMARY OF THE INVENTION

1. Introduction

This invention relates to stringed musical instruments. A combination of two or more instruments favored by the player resulting in rapid change of instruments while playing, reduced storage volume and lower cost. Many musicians branch out as they gain expertise with one instrument and desire to play other instruments. Many musical accompaniments use different stringed instruments played at different times. When the performer is a singer playing an instrument allows the singer to set the tempo of the music which is more discernable on a plucked instrument such as a mandolin. The violin gives the performer a separate instrument to play during instrumental breaks in the lyrics. The preferred embodiment of this invention is of a commercially available violin with added fixtures that transform the back of the violin body into a mandolin. The invention further includes a hook/holster generally hung from the player's belt line to hold the violin bow when it is not needed.

2. Prior Art

Combinations of stringed musical instruments are very old in the art. U.S. Pat. No. 832,157 issued to Platis in 1906 teaches a mandolin arm bolted to the face of a guitar. The body of a guitar is several times the volume of a standard mandolin, the quality of the connection to the guitar body, the position on the sounding body and other factors affect the quality of sound produced. The overall size of the instrument affects the player's ability to manipulate it as a mandolin.

U.S. Pat. No. 1,554,806 issued to Furia in 1925 describes a banjo with an additional neck extending from its back at an acute angle to the banjo neck with other necessary fixtures to create a mandolin on that surface. The banjo relies on a drum like head on which the bridge rests to define and amplify its sound. The resonance from that combination would differ from a hollow wooden body. The neck positions would also restrict quick manipulation from one instrument to the other and involve an awkward case.

U.S. Pat. No. 3,130,625 issued to Savona in 1964 describes a modular electric guitar that accepts more than one instrument in the form of detachable arms. That patent cites it usefulness as applied to instruments that are also equipped with electrical pickups. Savona also cites the body being acoustical however the sound quality would be affected by the position of the instrument arm and the quality of the attachment.

U.S. Pat. No. 3,636,809 issued to Ezaki in 1972 describes a two neck acoustic guitar. The necks support each other for a thinner structure but would interfere with reaching over the topside to cord with the thumb. That design does not include accommodating a string path in the head that cross for each instrument to allow a narrow neck near the head.

Other variations exist that address different feature: U.S. Pat. No. 4,953,434 dual chambers rotatable with opposing necks; U.S. Pat. No. 4,981,063 four sided electric guitar arm; U.S. Pat. No. 4,987,815 electric guitar mounted on acoustic body; U.S. Pat. No. 5,212,329 detachable electric guitar mounted on saddle of acoustic body; U.S. Pat. No. 5,571,980 floor mounted support for dual instrument; U.S. Pat. No. 6,649,818 U shaped solid body electric guitar and many other variations. Each of these has attributes and limitations but do not fulfill the usefulness of the present invention.

DESCRIPTION OF THE INVENTION

The preferred embodiment is produced by adding features to the back of a violin to create a mandolin side. All features described here are on the back of the violin. A sound hole is formed in the back of the violin central to the body and bias toward the neck. The finish is sanded away from the areas of the violin where the following parts will be attached. A neck adaptor is affixed to the back of the violin neck to support a finger board. The surface of the neck adaptor opposite the violin neck describes a straight line from the violin neck and head joint to the back surface of the violin body and generally has an elongated triangular profile. A predetermined area of the lower neck "heel" where it attaches to the body and back of the violin are cut away to create a reduced area which lowers the angle that the second finger board will make with respect to the violin finger board. The finger board extends from the violin head across the neck adaptor, across the reduced area of the violin body and extends a predetermined distance over the violin body proximate to the sound hole. A nut is attached to head end of the finger board perpendicular to the neck for the strings to be drawn over as common to many stringed instruments. A finger board face is affixed to the finger board which is fretted commensurate with a mandolin. A second head is affixed to the back of the violin head to provide structure to mount tuning pegs. Much of the second head structure is above the plane described by the finger board face. A recurve nut is mounted between the nut and pegs to create and over and under path for the string over the nut and under the recurve nut to hold the strings against the nut. The attachments and sanded area of the violin are then coated with a protective and decorative finish. A string anchor is attached to the body of the violin opposite the neck. Strings are attached to the string anchor and drawn over a second bridge placed on the violin body between the string anchor and the sound hole then over the nut and under the recurve nut and then routed to the pegs. The second bridge placement establishes the free playing length of the strings. The pegs are turned to create tension on the strings to produce the desired tone or frequency of the string as it is tuned. This preferred embodiment is built on a violin which requires a bow to play. Also included in the invention is a clip and hook/holster which attaches to an article of the player's clothing to provide a convenient holder for the bow while the mandolin side of the instrument is played.

DETAILED DESCRIPTION OF THE DRAWINGS

Figure 1:
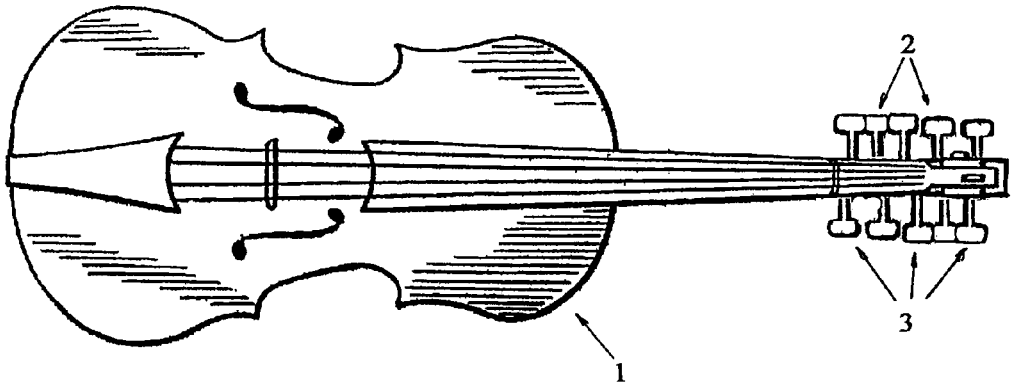
FIG. 1. is a front view of the violin.

FIG. 1. shows a front view of a commercially available violin with its standard features which have been modified into a Fiddolin 1. Also shown in this view are the four standard violin tuning pegs 2 and six tuning pegs 3.

Figure 2:
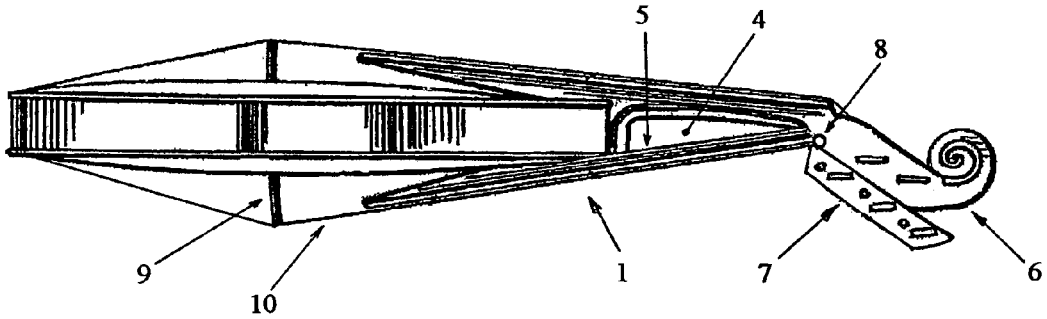
FIG. 2. is a side view of the combined instrument.

FIG. 2. shows a side view of the Fiddolin 1. Neck adaptor 4 supports second finger board 5. Violin head 6 has been modified to receive second head section 7 which further houses six tuning pegs 3 and recurve nut 8. second bridge 9 is of sufficient height to keep strings 10 generally parallel to finger board 5.

Figure 3:
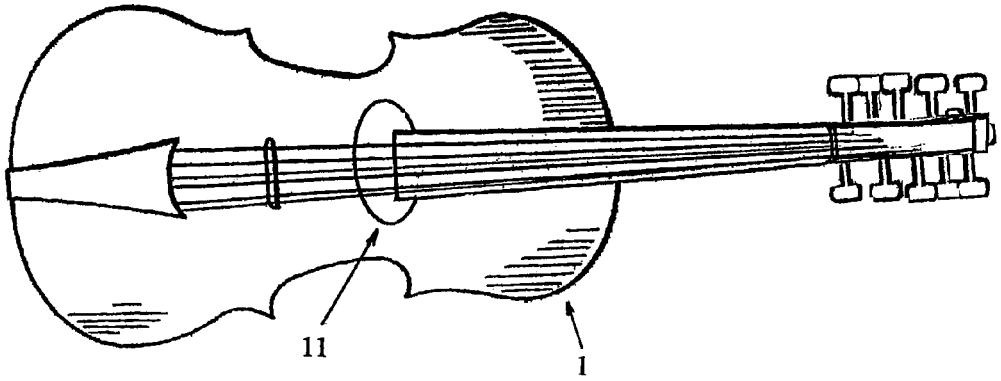
FIG. 3. is a back view of the combined instrument which is the mandolin.

FIG. 3. shows a front view of the mandolin side of the Fiddolin 1. Second sounding hole 11 is also shown.

Figure 4:
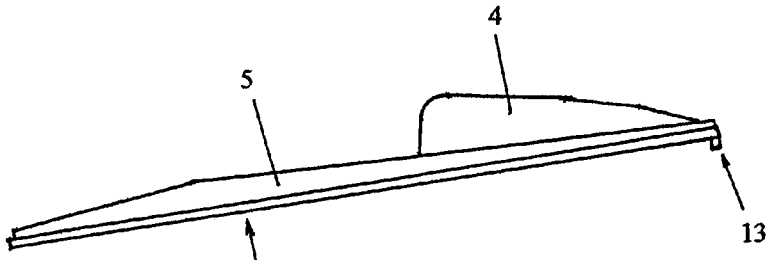
FIG. 4. is a side view of the neck adaptor, finger board, finger board face and nut.

FIG. 4. shows a side view of neck adaptor 4. Finger board 5 is joined to neck adaptor 4 in a T configuration and finger board face 12 is mounted on finger board 5. Nut 13 is mounted across the head end of finger board 5.

Figure 5:
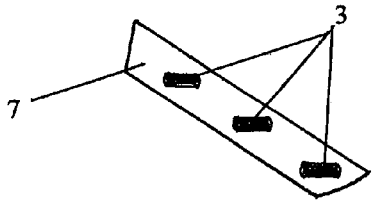
FIG. 5. is a side view of the second head.

FIG. 5. shows a side view of second head 7 with mandolin pegs 3. second head 7 may be milled from solid wood or assembled from wooden components.

Figure 6:
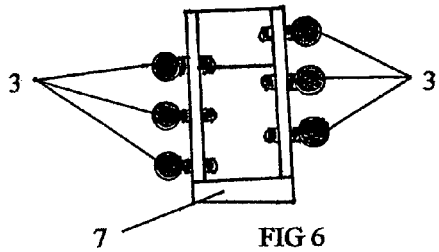
FIG. 6. is a top view of the second head.

FIG. 6. shows a top view of second head 7 with pegs 3 shown in profile.

Figure 7:
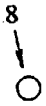
FIG. 7. is an end view of the recurve nut.

FIG. 7. shows an end view of recurve nut 8.

Figure 8:
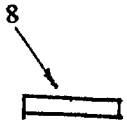
FIG. 8. is a front view of the recurve nut.

FIG. 8. shows a side view of recurve nut 8 which is a rod.

Figure 9:
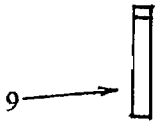
FIG. 9. is a side view of the second bridge.

FIG. 9. shows a side view of second bridge 9.

Figure 10:
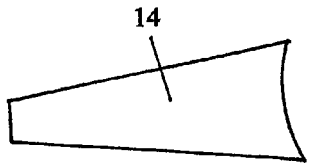
FIG. 10. is a top view of the string anchor.

FIG. 10. shows a top view of string anchor 14.

The preferred embodiment of this invention has been portrayed in the description and drawings and is not intended as a limitation on other adaptations of this invention. Those skilled in the art can envision various adaptations of this invention to create dual purpose instruments by modification of existing instruments.

I claim:

1. A stringed musical instrument combination of two traditional stringed musical instruments generally having at least a body and neck comprising:

a first stringed musical instrument comprising the structure of a preexisting stringed musical instrument and a second stringed musical instrument configuration comprising:

a neck adaptor adaptive to and affixed to the back of said first stringed musical instrument neck;

a second finger board affixed to said neck adaptor;

second finger board face fretted or unfretted as dictated by said second musical instrument configuration affixed to said second finger board;

a nut affixed to said second finger board distal to said first stringed musical instrument body;

a second head section adaptive to and affixed to said first stringed musical instrument head adaptive to receive pegs;

a peg for each string;

a recurve nut mounted in said second head between said nut and said pegs in a position to create and over and under path for the strings between the nut and pegs;

a bridge mounted on the back of said first stringed musical instrument at a predetermined position its distance from said nut defining the free playing length of said strings;

a string anchor affixed to the back of said first stringed musical instrument opposite said neck;

the back of said first stringed musical instrument body defining at least one sounding hole and further defining a reduced area to accommodate reducing the angle of said second finger board relative to said preexisting stringed musical instrument's finger board; and said strings are connected to their respective string anchors and stretched across their respective bridges and nuts by tension created by its respective peg manipulated to create the desired tone tension.

2. The stringed musical instrument of clam 1 wherein said first stringed musical instrument comprising a violin and said second stringed musical instrument configuration comprising a mandolin.

3. The stringed musical instrument of claim 1 wherein said first stringed musical instrument comprising a violin and said second stringed musical instrument configuration of a mandolin having at least one less string than traditional for mandolins.

4. The stringed musical instrument of claim 1 wherein said first stringed musical instrument comprising a violin and said second stringed musical instrument configuration of a mandolin having only one G string and one D string.

5. The stringed musical instrument of claim 1 further comprising a clip and hook/holster remove-able attached to an article of clothing worn by the player which holds a bow when it is not required.

6. A stringed musical instrument combination of a violin and a mandolin comprising:

the structure of a preexisting violin, and a neck adaptor adaptive to and affixed to the back of said violin neck having a second finger board opposite said violin finger board;

a fretted finger board face affixed to said second finger board;

a nut affixed to said fretted finger board distal to said violin body;

a second head section adaptive to and affixed to said violin head adaptive to receive pegs;

a peg for each string;

a recurve nut mounted in said second head between said nut and said pegs in a position to create and over and under path for the strings between the nut and pegs;

a bridge mounted on the back of said violin at a predetermined position its distance from said nut defining the free playing length of said strings;

a string anchor affixed to the back of said violin opposite said neck;

the back of said violin body defining at least one sounding hole and further defining a reduced area to accommodate reducing the angle of said second finger board relative to said violin's finger board;

strings including two E, two A, one D and one E;

said strings are connected to their respective string anchors and stretched across their respective bridges and nuts by tension created by its respective peg manipulated to create the desired tone tension; and a clip and hook/holster remove-able attached to an article of clothing worn by the player which holds a bow when it is not required.

7. The method of modifying a violin into a Fiddolin by adding a mandolin structure on its back comprising the steps:

providing a complete violin, neck adaptor, second finger board, finger board face, nut, recurve nut, second head section, pegs, bridge, tail stock with string anchor and strings;

sanding the back of the violin neck and head in the areas the following parts will be attached;

creating a reduced area on the back of said violin by removing material from the violin's neck lower base and back of violin of a predetermined shape to allow said finger board to fit at a predetermined angle to the violin finger board;

cutting at lease one sound hole in the back of the violin;

affixing said neck adaptor to the back of the violin's neck;

affixing said second finger board to said adaptor with its distal end is proximal to the violin's head and also affixed its proximal end to the back of the violin within said reduced area;

affixing said finger board face to said finger board;

affixing said nut to the distal end of said finger board;

removing material from the violin's head to accommodate joining said second head to it;

affixing said second head section to the violin head;

affixing said recurve nut to said second head section proximal to said nut applying a decorative and protective finish to the affixed parts and any sanded regions of said violin;

affixing said tail stock with string anchor to the back of said violin distal to its neck;

installing said pegs in said second head;

installing at least one string;

positioning said bridge;

installing any remaining strings; and tuning both instruments.

* * * * *